US007938200B2

(12) United States Patent
Traylor

(10) Patent No.: US 7,938,200 B2
(45) Date of Patent: May 10, 2011

(54) APPARATUS AND METHOD FOR A HYDRAULIC DIAPHRAGM DOWNHOLE MUD MOTOR

(75) Inventor: Leland B. Traylor, Draper, UT (US)

(73) Assignee: Smith International, Inc., Houston, TX (US)

( * ) Notice: Subject to any disclaimer, the term of this patent is extended or adjusted under 35 U.S.C. 154(b) by 131 days.

(21) Appl. No.: 11/947,526

(22) Filed: Nov. 29, 2007

(65) Prior Publication Data

US 2009/0139769 A1 Jun. 4, 2009

(51) Int. Cl.
*E21B 4/02* (2006.01)

(52) U.S. Cl. ..... 175/107

(58) Field of Classification Search ..... 175/107, 175/95; 417/903

See application file for complete search history.

(56) References Cited

U.S. PATENT DOCUMENTS

| | | | | |
|---|---|---|---|---|
| 2,435,179 | A | 1/1948 | McGovney | |
| 4,187,918 | A | 2/1980 | Clark | |
| 4,402,370 | A | 9/1983 | Gein et al. | |
| 4,462,469 | A * | 7/1984 | Brown | 175/40 |
| 4,534,427 | A | 8/1985 | Wang et al. | |
| 4,986,307 | A * | 1/1991 | Hardee | 137/625.19 |
| 6,289,998 | B1 | 9/2001 | Krueger et al. | |
| 6,595,280 | B2 | 7/2003 | Traylor | |
| 6,889,765 | B1 | 5/2005 | Traylor | |
| 2006/0113114 | A1 | 6/2006 | Jin et al. | |

OTHER PUBLICATIONS

PCT Written Opnion of the International Search Authority and PCT International Search Report; Jun. 24, 2009; 10 pgs.

* cited by examiner

*Primary Examiner* — Kenneth Thompson
*Assistant Examiner* — Catherine Loikith
(74) *Attorney, Agent, or Firm* — Osha Liang LLP

(57) ABSTRACT

A downhole motor to drill a wellbore including a pumping apparatus having a first chamber configured to receive a first fluid and a second fluid, and a first flexible diaphragm disposed with the first chamber configured to separate the first and second fluid, wherein the first flexible diaphragm is configured to transfer a hydraulic energy between the first fluid and the second fluid. In addition, the downhole motor includes a motor portion coupled to the pumping apparatus and configured to receive the second fluid and convert the hydraulic energy of the second fluid into a mechanical energy, thereby creating a torque. Further, the downhole motor includes a bit shaft coupled to the motor portion, configured to receive the torque from the motor portion and the first fluid from the pumping apparatus.

23 Claims, 5 Drawing Sheets

APPARATUS AND METHOD FOR A HYDRAULIC DIAPHRAGM DOWNHOLE MUD MOTOR

BACKGROUND OF DISCLOSURE

1. Field of the Disclosure

Embodiments disclosed herein relate generally to apparatus and methods for downhole drilling operations. More specifically, embodiments disclosed herein relate to a downhole hole mud motor.

2. Background Art

In the drilling of well bores in the oil and gas industry, it is common practice to use downhole motors to drive a drill bit through a formation. As used herein, a "downhole motor" may refer generally to any motor used in a well bore for drilling through a formation. These downhole motors may typically be driven by pumping drilling fluids (e.g., "mud") from surface equipment downhole through the drill string. As such, this type of motor is commonly referred to as a mud motor. When in use, the drilling fluid may be forced from the surface through the motor portion of the mud motor, in which energy from the flow of the drilling fluid may be used to provide rotational force to a drill bit located below the mud motor. As used herein, a "motor portion" may refer to the portion of the downhole motor that generates torque. There are two primary types of mud motors: positive displacement motors ("PDM") and turbine motors.

The first type of mud motor, PDM, may be used to convert the energy of high-pressure drilling fluid into rotational-mechanical energy to rotate the drill bit. An early example of a PDM is given in U.S. Pat. No. 4,187,918 ("Clark"). As shown in Clark, a PDM typically has a helical stator attached to a distal end of the drillstring. The PDM may also have an eccentric helical rotor that corresponds to the helical stator and is connected through a driveshaft to the remainder of a bottom hole assembly ("BHA") therebelow. Drilling fluids may be pressurized to flow through the bore of the drillstring to engage the stator and rotor, thereby creating a resultant torque between the stator and the rotor. This torque may then be transmitted to the drill bit to rotate the drill bit. Historically, PDM's have been characterized as having a low-speed and high-torque when rotating the drill bit. Accordingly, PDM's may generally be best suited for use with roller cone and polycrystalline diamond compact (PDC) bits. However, the rotors of PDM's have been known to have eccentric motion, thereby creating large lateral vibrations that may damage other drill string components.

The second type of mud motor, the turbine motor, generally uses one or more turbine power sections to provide rotational force to a drill bit. Each power section may consist of a non-moving stator vane, and a rotor assembly comprising rotating vanes mechanically linked to a rotor shaft. These power sections are designed such that the vanes of the stator direct the flow of drilling fluid into corresponding rotor blades to provide rotation. The rotor shaft, which may be a single piece, or may comprise two or more connected shafts, such as a flexible shaft and an output shaft, then ultimately connects to and drives the drill bit. Thus, the high-speed drilling fluid flowing into the rotor vanes causes the rotor and the drill bit to rotate with respect to the stator housing. Historically, turbine motors have been characterized as having a high-speed and low-torque, when rotating the drill bit. Furthermore, because of the high speed, and because by design no component of the rotor moves in an eccentric path, the output of a turbine motor is typically smoother than the output of PDM's and considered appropriate for use with PDC bits drilling high compressive strength formations.

Drilling fluid, as used in oilfield applications, is typically pumped downhole through a bore of the drillstring at high pressure. Once downhole, the drilling fluid is pumped through the downhole mud motor, where the fluid is exposed to internal components of the downhole motor, such as bearings and seals. After the drilling fluid has passed through the downhole mud motor, the drilling fluid is then transferred to the drill bit and communicated to the well bore through a plurality of nozzles. Here the drilling fluid cools and lubricates the drill bit, in addition to cleaning drill cuttings away from cutting surfaces of the drill bit and the wellbore. The drilling fluid is then expelled to return to the surface through an annulus formed between the wellbore (i.e., the inner diameter of either the formation or a casing string) and the outer profile of the drillstring. Accordingly, the drilling mud returns to the surface carrying drill cuttings disposed therein. Because the drilling fluid is exposed to the internal components of the downhole motor, the chemical composition and viscosity of the drilling fluid must be carefully considered. The composition and viscosity may have a direct or indirect impact on the internal components of the downhole motor, such as reliability and maintainability.

Both the PDM and the turbine motor, discussed above, require the drilling fluid to be pumped from the surface and circulated through the motor portion of the downhole motor. Thus, the internal components of the PDM and the turbine motor are exposed to the drilling fluid and, therefore, may be affected by the viscosity and the composition of the drilling fluid. This exposure, as described above, may cause the internal components of the PDM and the turbine motor to wear down quickly. Further, this exposure may result in a less reliable and maintainable downhole motor.

Thus, there exists a need for a fluid driven downhole motor that is more reliable and maintainable.

SUMMARY OF DISCLOSURE

In one aspect, embodiments disclosed herein relate to a downhole motor for drilling a wellbore including a pumping apparatus having a first chamber configured to receive a first fluid and a second fluid, and a first flexible diaphragm disposed with the first chamber configured to separate the first and second fluid, wherein the first flexible diaphragm is configured to transfer a hydraulic energy between the first fluid and the second fluid, a motor portion coupled to the pumping apparatus and configured to receive the second fluid and convert the hydraulic energy of the second fluid into a mechanical energy, thereby creating a torque, and a bit shaft coupled to the motor portion, configured to receive the torque from the motor portion and the first fluid from the pumping apparatus.

In one aspect, embodiments disclosed herein relate to a method of operating a downhole motor including pumping a first fluid containing a hydraulic energy to the downhole motor, directing the flow of the first fluid into a first chamber of a pumping apparatus, transferring hydraulic energy from the first fluid to a second fluid through a first flexible diaphragm disposed in the first chamber, directing the flow of the second fluid from the pumping apparatus into a motor portion, allowing the second fluid to flow through the motor portion, wherein the motor portion is configured to transfer hydraulic energy of the second fluid into a mechanical energy, thereby creating torque, rotating a bit shaft with the torque generated from the motor portion, and directing the flow of the first fluid from the pumping apparatus to the bit shaft.

Other aspects and advantages will be apparent from the following description and the appended claims.

DETAILED DESCRIPTION

Embodiments of the present disclosure relate to a downhole drilling system. More specifically, select embodiments of the present disclosure relate to a hydraulic diaphragm downhole mud motor. The downhole motor of the present disclosure may be integrated into the downhole drilling system and driven by a fluid that is pumped therethrough. Further, the downhole motor of the present disclosure may be used to drill a wellbore by turning a drill bit.

Even more specifically, select embodiments relate to a downhole motor that is capable of using multiple types of fluids simultaneously. For example, in one embodiment a first fluid (such as drilling mud, or "mud fluid," herein) may be used in conjunction with a second fluid (such as a hydraulic fluid).

Generally, select embodiments disclosed herein relate to a downhole motor having a diaphragm pump with at least two chambers. Each chamber has a diaphragm disposed therein configured to separate a first fluid from a second fluid. The first fluid is transferred downhole through a drill string to the downhole motor. The first fluid flows through the downhole motor to a drill bit that releases the first fluid into the wellbore. However, while flowing through the downhole motor, the first fluid does not flow through the motor portion of the downhole motor. Thus, the first fluid is not exposed to the internal components of the motor portion. As a result, the first fluid is a mud fluid or other drilling fluid known in the art that provides a means to clean the wellbore. The second fluid is disposed in the downhole motor and is circulated through the motor portion of the downhole motor. Thus, to prevent wear on the internal components of the downhole motor, the second fluid is a clean hydraulic fluid or other non-abrasive fluid known in the art. Those having ordinary skill in the art will appreciate that other fluid combinations may be used.

Figure 1:
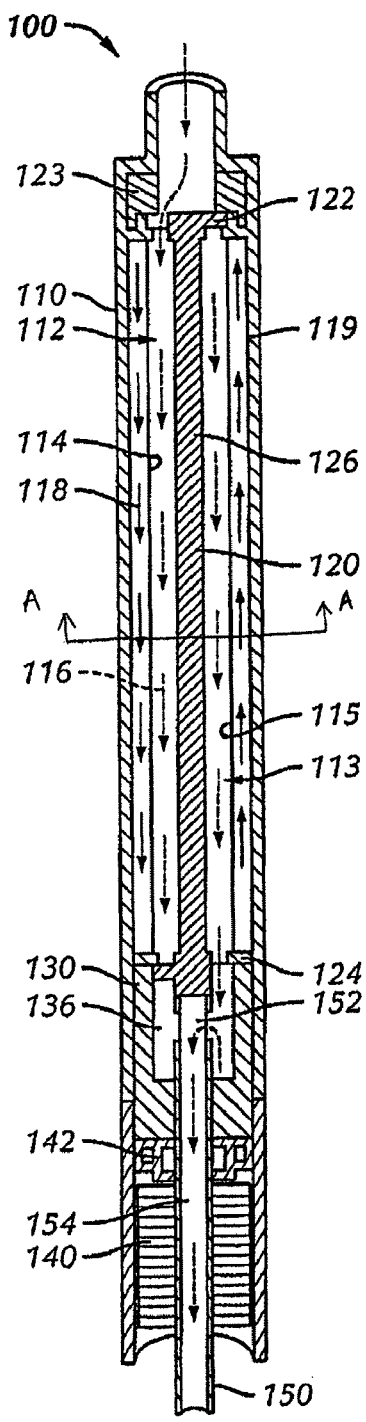
FIG. 1 shows a cross-sectional view of a downhole motor in accordance with embodiments of the present disclosure.

FIG. 1 shows a cross-sectional view of a downhole motor 100 in accordance with embodiments of the present disclosure. Downhole motor 100 includes a pumping apparatus 110, a motor portion 140, and a bit shaft 150. As shown in FIG. 1, the pumping apparatus 110 includes a first chamber 112 and a second chamber 113. The first chamber 112 includes a first flexible diaphragm 114 disposed therein, and the second chamber 113 includes a second flexible diaphragm 115 disposed therein. The diaphragms 114, 115 separate a second fluid 118 from a first fluid 116 that are both received by the chambers 112, 113 of the pumping apparatus 110.

In one embodiment, the diaphragms 114, 115 may be cylindrical in shape and manufactured out of a flexible material, such as rubber, Teflon, or other materials known in the art. In alternate embodiments, other shapes, including regular and irregular shaped diaphragms may be used, such that the diaphragm may separate two fluids within a chamber 112, 113. Furthermore, the flexibility of the diaphragms 114, 115 allows a transfer of hydraulic energy between the fluids 116, 118. For example, the pumping apparatus 110 may receive a first fluid 116 in the first flexible diaphragm 114, while a second fluid 118 is disposed in the first chamber 112, outside the first flexible diaphragm 114. As the first fluid 116 fills the first flexible diaphragm 114, a pressure within the diaphragm 114 increases, causing the diaphragm 114 to expand. During this expansion, the first flexible diaphragm 114 transfers hydraulic energy from the first fluid 116 to the second fluid 118, while maintaining physical separation of the fluids 116, 118.

In the embodiment shown, the diaphragms 114, 115 are positioned proximate a center annulus of the pumping apparatus 110. This allows the diaphragms 114, 115 to be closely aligned with the flow of the first fluid 116 entering the pumping apparatus 110, thereby reducing hydraulic energy loss due to the redirection of the flow of the first fluid 116. In an alternate embodiment, the diaphragms 114, 115 may be positioned proximate inner circumference 119 of the pumping apparatus 110.

In one embodiment of the present disclosure, the pumping apparatus may include an odd number of chambers and diaphragms, for example, five chambers with a diaphragm disposed in each chamber. An odd number of chambers may decrease the amount of vibrations generated by the downhole motor during operations. However, one skilled the art would appreciate that the motor may have an even number of chambers without departing from the scope of embodiments disclosed therein.

The pumping apparatus 110 further includes a valve system 120 having an upper valve 122, an upper valve housing 123, a lower valve 124, a fluid housing 130, and a shaft 126. The valves 122, 124 are coupled to the shaft 126, which extends through the center annulus of the pumping apparatus 110. The valves 122, 124 may be coupled to the shaft 126 through the use of threads, bearings, or other attachment methods known in the art. The valves 122, 124 are configured to control the flow of the first and second fluid 116, 118 entering and exiting the pumping apparatus 110. In one embodiment the valve system 120 may be directly connected to the bit shaft 150 or, in an alternate embodiment, the valve system 120 may be connected to another device (not shown) that turns the shaft 126 independently of the bit shaft 150.

Figure 6:
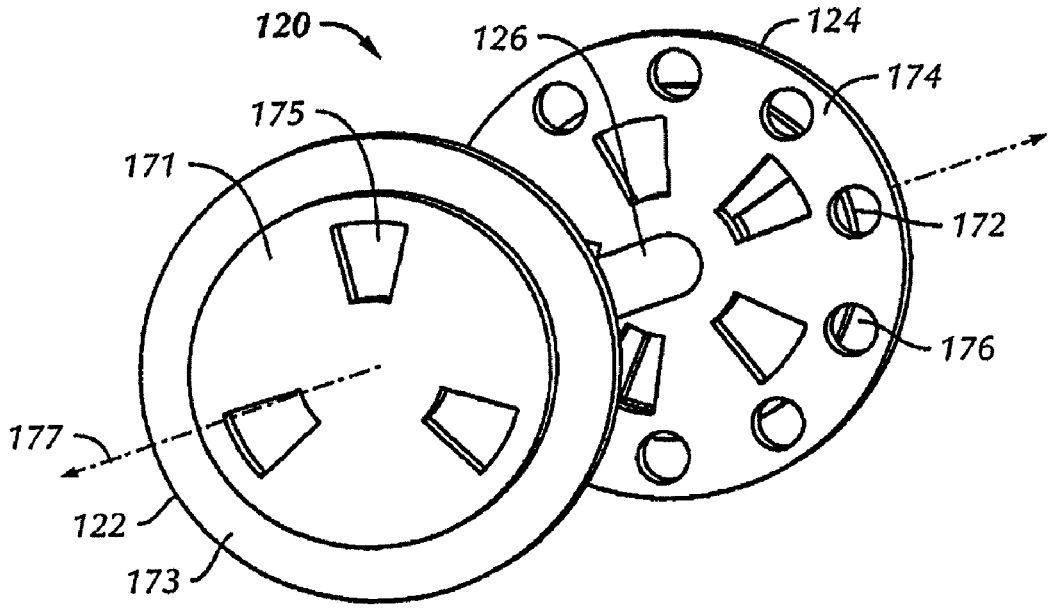
FIG. 6 shows a component view of a valve system in accordance with embodiments of the present disclosure.

A component view of the valve system 120 in accordance with the embodiments of the present disclosure is shown in FIG. 6. As shown in FIG. 6, the upper valve 122 includes a top plate 171 and a bottom plate 173 both having a plurality of orifices 175 radially disposed about a central axis 177. Each of the plates 173, 171 are configured to rotate around the central axis 177. As the bottom and top plate 173, 171 rotate about the central axis 177, an orifice 175 from the top plate 171 may align with an orifice 175 from the bottom plate 173. This alignment may form a passageway allowing the first fluid 116 to flow through the upper valve 122.

Further, the lower valve 124 includes a first plate 172 and a second plate 174 both having a plurality of orifices 175 radially disposed about the central axis 177, similar to those of the upper valve 122. However, the second plate 174 of the lower valve 223 also includes a plurality of bores 176 that are also radially disposed about the central axis 177. Both plates 172, 174 may be configured, similar to the plates 171, 173 of the upper valve 122, so as to rotate about the central axis 177. An orifice 175 on the first plate 172 may be configured to align with an orifice 175 on the second plate 174 to form a passageway that will allow the first fluid 116 to flow through the lower valve 124. Further, a bore 176 disposed on the second plate 174 may be configured to align with an opening in another component, such as the fluid housing 130 shown in FIG. 1, that will allow the second fluid 118 to flow trough the lower valve 124.

Figure 7:
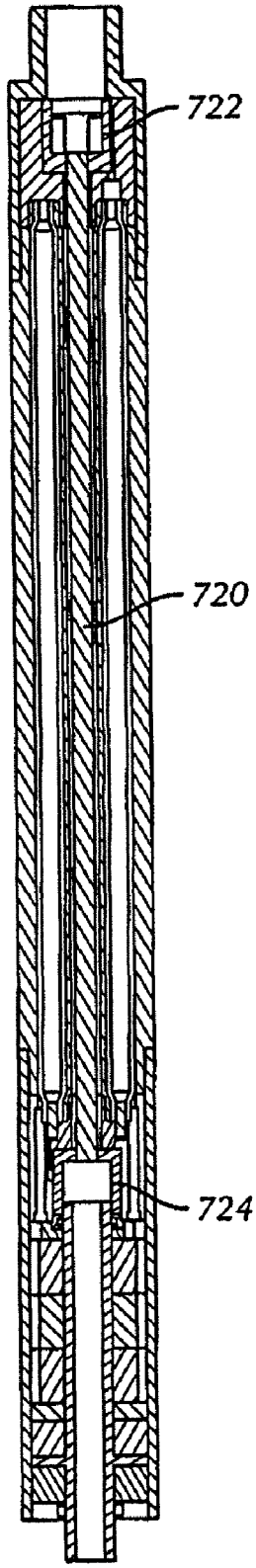
FIG. 7 shows a cross-sectional view of a downhole motor in accordance with the embodiments of the present disclosure.

As shown in FIG. 6, the valve system includes an upper and a lower valve having disk-shaped plates with a plurality of openings (e.g., orifices and bores) extending from the upper face to the lower face of each plate (e.g., top plate). In an alternate embodiment the valve system may include other type valve assemblies known in the art. For example, a cylinder type valve assembly 720, as shown in FIG. 7 may be used. Cylinder type valve assembly 720 includes an upper valve 722 and a lower valve 724, each having a cylindrical shape and each valve having a plurality of openings extending through a wall of a cylinder. Further, the valve assembly 720 is configured to direct and control the flow of a first fluid and a second fluid, similar to the valve system shown in FIG. 1.

In one embodiment, the valve system 120 of the downhole motor 100 may be configured to be driven independently by, for example, a turbine blade in the first fluid 116 or a separate motor portion 140. A sensor may be configured to transmit and receive a signal that is transferred between the sensor and a controller (not shown). The controller may be located at the surface of the well and used to control the flow rate of the first fluid 116 flowing through the downhole motor 100. This control may result in the downhole motor 100 having the capability of running at a variety of torques and speeds.

Referring back to FIG. 1, the valves 122, 124 may be configured to control which chamber (e.g., the first and second chambers 112, 113) the first and second fluid 116, 118 enter and exit. For example, the upper valve 122 may be rotated to a position where an orifice 175 of the top plate 171 and an orifice 175 of the bottom plate 173 align above the first chamber 112. While the orifices 175 of these plates 171, 173 are at least partially aligned above the first chamber 112, the first fluid 116 will flow into the first flexible diaphragm 114 of the first chamber 112.

After the first diaphragm 114 fills, the lower valve 124 may be rotated to a position where a bore 176 of the second plate 174 aligns with a first channel of the fluid housing 130 below the first chamber 112. While the bore 176 and the channel are at least partially aligned below the first chamber 112, the second fluid 118 may flow out of the first chamber 112 and into the first channel of the fluid housing 130.

Once the second fluid 118 has circulated through the motor portion 140 and into a second channel of the fluid housing 130, the lower valve 124 may be rotated to a position where a bore 176 aligns with a second channel in the fluid housing 130 below the second chamber 113. While the bore 176 is at least partially aligned with the second channel of the fluid housing 130 below the second chamber 113, the second fluid 118 may flow out of the fluid housing 130 and into the second chamber 113.

Following the second fluid 118 filling the second chamber 113, the lower valve 124 may be rotated to a position where an orifice 175 of the first plate 172 and an orifice 174 of the second plate 174 align below the second chamber 113. When the orifices 175 of these plates 172, 174 are at least partially aligned below the second chamber 113, the first fluid 116 will flow out of the second flexible diaphragm 115 and into an annular space of the fluid housing 130.

The fluid housing 130, as shown in FIG. 1, may be coupled to the pumping apparatus 110 and the motor portion 140, using bolts, bearings, seals, or any other elements known in the art. As depicted in FIG. 1, the pumping apparatus 110 may be coupled to one end of the housing 130, i.e., upper face, and the motor portion 140 may be coupled to the opposite end of the housing 130, i.e., a lower face.

Figure 3:
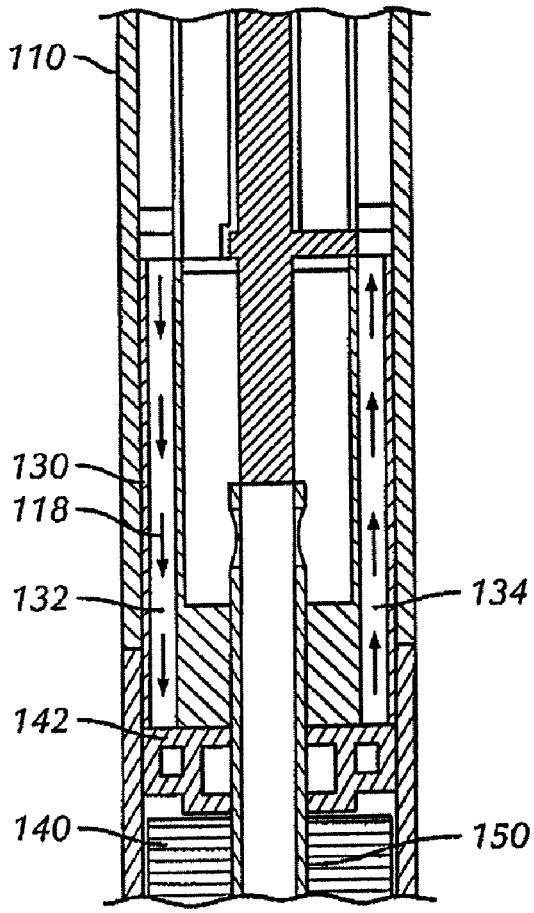
FIG. 3 shows a close cross-sectional view of a housing of a downhole motor in accordance with embodiments of the present disclosure.

FIG. 3 shows a close cross-sectional view of the housing 130 of the downhole motor 100 in accordance with the embodiments of the present disclosure. As shown in FIG. 3, the fluid housing 130 may include a first channel 132 and a second channel 134. Each channel may extend the length of the housing 130, thereby creating a passage way between the pumping apparatus 110 and the motor portion 140. The channels 132, 134 may be of various shapes and cross-sections, such as a cylindrical, square, elliptical, triangular, or others known in the art. These channels 132, 134 are configured to transfer a second fluid 118 between the pumping apparatus 110 and the motor portion 140. For example, the second fluid 118 exiting the first chamber 112 of the pumping apparatus 110 flows through the first channel 132 to the motor portion 140. After the second fluid 118 has circulated through the motor portion 140, the second fluid 118 exiting the motor portion 140 flows through the second channel 134 back into the second chamber 113 of the pumping apparatus 110. One skilled in the art of drilling will appreciate that the fluid housing 130 may include additional fluid passages. For example, a fluid housing may include a first channel, a second channel, and a third channel, such that each channel is used to transport a fluid.

The motor portion 140 includes a motor valve 142, and at least one thrust bearing (not shown). Additionally, the motor portion 140 may include, for example, a rotor and a stator, and other components known in the art. The motor valve 142 is coupled to the fluid housing 130 and controls the flow of the second fluid 118 entering and exiting the motor portion 140 of the downhole motor 100. At least one thrust bearing may be disposed between the bit shaft 150 and the motor portion 140 to transfer torque from the motor portion 140 to the bit shaft 150. The motor portion 140 is then driven by the second fluid 118 flowing therethrough. The second fluid 118 flows through the motor portion 140, wherein hydraulic energy of the fluid 118 is converted into mechanical energy to turn the bit shaft 150.

In an alternate embodiment, the motor valve 142 may be replaced with a set (2) of opposed check valves. In this embodiment, the check valves may operate independent from the valve system 120, thereby allowing the valve system 120 to be driven independently, for example, by a separate motor portion 140. At least one of the two check valves is configured to control the flow of the second fluid 118 entering the motor portion 140, while the other check valve is configured to control the flow of the second fluid 118 exiting the motor portion 140.

Referring back to FIG. 1, the fluid housing 130 also includes an annular space 136. The annular space 136 may extend downward from the upper face some distance to a location above the lower face of the housing 130. Further, the annular space 136 provides a passage way between the pumping apparatus 110 and the bit shaft 150. For example, the first fluid 116 exiting the pumping apparatus flows into the annular space 136 of the fluid housing 130. As the annular space 136 fills with the first fluid 116, the first fluid 116 flows though an opening in the bit shaft 150.

Finally, the bit shaft 150, as shown in FIG. 1, includes an opening 152 that may be located near the upper end of the bit shaft 150. The bit shaft 150 may extend from a location below the downhole motor 100 upward through the motor portion 140 and into the fluid housing 130. More specifically, the upper end of the bit shaft 150 may be received by the annular space 136 of the fluid housing 130. Further, the bit shaft 150 may be coupled to the motor portion 140 by any means know in the art, for example, at least one thrust bearing. Furthermore, the bit shaft 150 includes a channel 154 that may be configured to transfer the first fluid 116 to a lower distal end of the bit shaft 150. For example, the first fluid 116 flowing out of the second chamber 113 may flow into the annular space 136 of the fluid housing 130. As the annular space 136 fills with the first fluid, the first fluid will flow through the opening 152 at the upper end of the shaft into the channel 154. The first fluid 116 may then continue to flow downward through the channel 154 within the bit shaft 150 to the lower distal end of the bit shaft 150.

It should be understood that the downhole motor 100, in accordance with the embodiments disclosed herein, may be incorporated into a drilling assembly. The drilling assembly may comprise of a drill string (not shown), the downhole motor 100, a drill bit (not shown), and other components known in the art. Thus, the downhole motor 100 may be configured to be coupled to the drill string and the drill bit. One skilled in the art will appreciate that the downhole motor 100 may be used with pre-existing drill strings and drill bits. These pre-existing drill strings and drill bits may be coupled to the downhole motor 100 using attachment methods known in the art of drilling, for example, threaded connections, welding, and bearings.

During the operation of the downhole motor 100, the first fluid 116 may be pumped downhole through the drill string to the downhole motor 100. Once the fluid 116 reaches the downhole motor 100, the upper valve 122 may be rotated to a position to allow the first fluid 116 into the first flexible diaphragm 114 of the first chamber 112. The upper valve 122 is rotated at a predetermined speed. The predetermined speed may be dependent on the size of the wellbore, the type of formation, desired Rate of Penetration (ROP), and other factors known in the art.

As the first fluid 116 fills the first flexible diaphragm 114, the first flexible diaphragm 114 expands. The expansion of the first flexible diaphragm 114 pressurizes the second fluid 118 also disposed in the first chamber 112, thereby transferring hydraulic energy from the first fluid 116 to the second fluid 118 outside of the diaphragm 114. The lower valve 124 may then be rotated to a position to allow the pressurized second fluid 118 to flow out of the first chamber 112 and into the first channel 132 of the fluid housing 130.

The second fluid 118 may then be transferred through the first channel 132 to the motor portion 140. The motor valve 142 may then allow the second fluid 118 from the first channel 134 to flow into the motor portion 140. While the second fluid 118 flows through the motor portion 140, the motor portion 140 converts the hydraulic energy of the second fluid 118 into mechanical energy, thereby creating torque. Further, the torque created by the motor portion 140 is transferred to the bit shaft 150 through at least one thrust bearing, which causes the bit shaft 150 to rotate.

After at least some of the second fluid 118 has passed through the motor portion 140, the motor valve 142 may allow the second fluid 118 to flow into the second channel 134 of the fluid housing 130. The lower valve 124 may then be rotated to a position to allow the second fluid 118 from the second channel 134 to flow into the second chamber 113, outside the second flexible diaphragm 115. As the second fluid 118 fills the second chamber 113, the second flexible diaphragm 115 compresses. The compression of the second flexible diaphragm 115 pressurizes the first fluid 116 disposed in the second flexible diaphragm 115, thereby transferring hydraulic energy from the second fluid 118 to the first fluid 116. The lower valve 124 may then be rotated to a position to allow the pressurized first fluid 116 to flow out of the second flexible diaphragm 115 and into the annular space 136 of the fluid housing 130. As the annular space 136 fills with the first fluid 116, the first fluid 116 may be forced to flow through the opening 152 of the bit shaft 150 into the channel 154. Finally, the channel 154 within the bit shaft 150 may transfer the first fluid 116 to the drill bit attached to the lower distal end of the bit shaft 150.

The drill bit may include nozzles (not shown) or other components known in the art that will receive the first fluid 116. These nozzles may release the first fluid 116 into a wellbore. One skilled in the art will appreciate that the first fluid 116 may be used to clean and cool the exterior surface of the drill bit. Further, the first fluid 116 may remove material, also known as cuttings, resulting from the drilling of a formation by the drill bit. The first fluid 116 along with the cuttings that were removed may then be transported upward through the wellbore.

Figure 2:
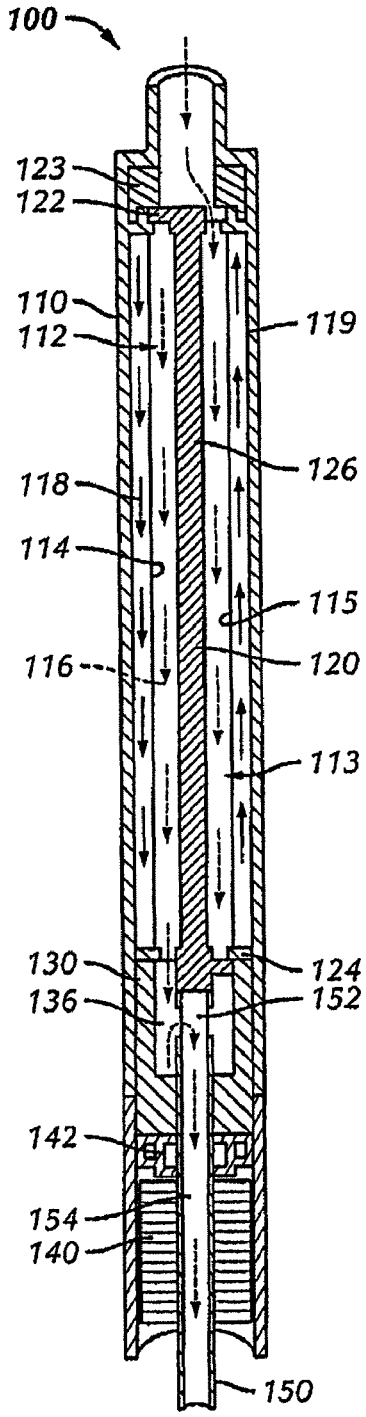
FIG. 2 shows a cross-sectional view of a downhole motor in accordance with embodiments of the present disclosure.
Figure 1C:
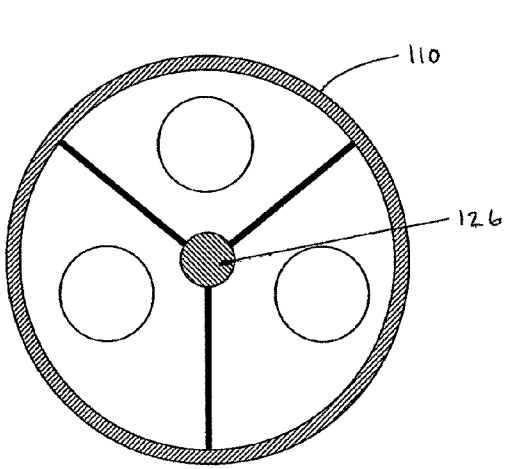
FIGS. 1A, 1B, and 1C show transverse cross-sectional views of the downhole motor of FIG. 1 taken along line A-A in accordance with embodiments of the present disclosure.
Figure 1B:
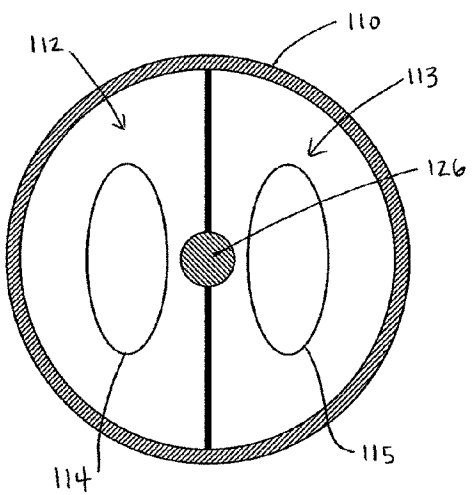
Figure 1A:
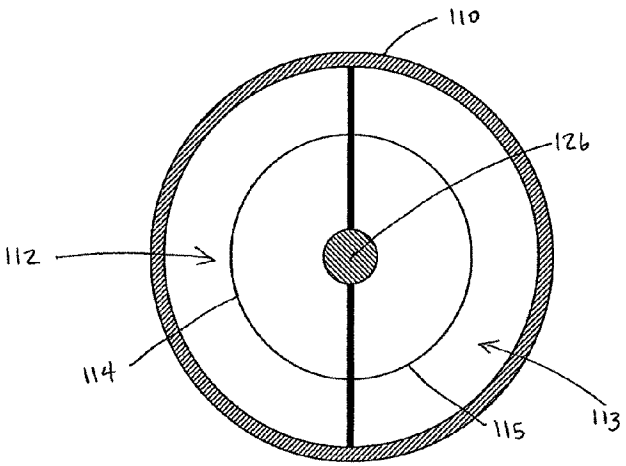

Referring now to FIG. 2, the upper valve 122 is rotated to a position to allow the first fluid 116 to flow into the second flexible diaphragm 115 of the second chamber 113. As the first fluid 116 fills the second flexible diaphragm 115, the second flexible diaphragm 115 expands. The expansion of the first flexible diaphragm 115 pressurizes the second fluid 118 also disposed in the second chamber 113, thereby transferring hydraulic energy from the first fluid 116 to the second fluid 118 outside of the diaphragm 115. The lower valve 124 may then be rotated to a position to allow the pressurized second fluid 118 to flow out of the second chamber 113 and into the second channel 134 of the fluid housing 130.

The second fluid 118 may then be transferred through the second channel 134 to the motor portion 140. The motor valve 142 allows the second fluid 118 from the second channel 134 to flow into the motor portion 140. While the second fluid 118 flows through the motor portion 140, the motor portion 140 converts the hydraulic energy of the second fluid 118 into mechanical energy, thereby creating torque. Further, the torque created by the motor portion 140 is transferred to the bit shaft 150 through at least one thrust bearing, which causes the bit shaft 150 to rotate.

After at least some of the second fluid 118 has passed through the motor portion 140, the motor valve 142 may allow the second fluid 118 to flow into the first channel 132 of the fluid housing 130. The lower valve 124 may then be rotated to a position to allow the second fluid 118 from the first channel 132 to flow into the first chamber 112, outside the first flexible diaphragm 114. As the second fluid 118 fills the first chamber 112, the first flexible diaphragm 114 compresses. The compression of the first flexible diaphragm 114 pressurizes the first fluid 118 disposed in the first flexible diaphragm 114, thereby transferring hydraulic energy from the second fluid 118 to the first fluid 116. The lower valve 124 may then be rotated to a position to allow the pressurized first fluid 116 to flow out of the first flexible diaphragm 114 and into the annular space 136 of the fluid housing 130. As the annular space 136 fills with the first fluid 116, the first fluid 116 may be forced to flow through the opening 152 of the bit shaft 150 into the channel 154. Finally, the channel 154 within the bit shaft 150 may transfer the first fluid 116 to the drill bit attached to the lower distal end of the bit shaft 150.

One skilled in the art will understand that the flow of the first fluid 116 into the downhole motor 100 may be alternated between the first chamber 112 and the second chamber 113, thereby allowing the drill bit to be continuously turned. Further, one skilled in the art would understand that the operation of the downhole motor 100 may start with the flow of the first fluid 116 entering the first chamber 112 or the second chamber 113. Furthermore, in embodiments where the downhole motor includes three or more chambers, the flow of the first and second fluid may be alternated between one or more chambers.

Figure 4:
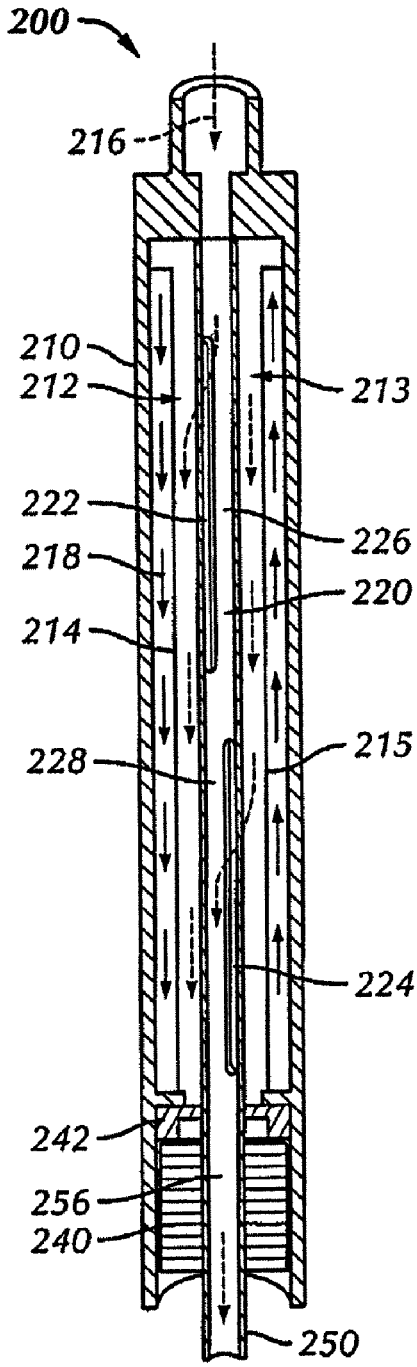
FIG. 4 shows a cross-sectional view of a downhole motor in accordance with embodiments of the present disclosure.

Referring now to FIG. 4, a cross-sectional view of a downhole motor 200 in accordance with embodiments of the present disclosure including a pumping apparatus 210, a motor portion 240, and a bit shaft 250. The pumping apparatus 210 includes chambers 212, 213 and flexible diaphragms 214, 215 disposed therein. Flexible diaphragms 214, 215 may be similar to those shown in FIG. 1 and discussed above. In this embodiment the flexible diaphragms 214, 215 of the pumping apparatus 210 receive the second fluid 218. Further, the chambers 212, 213 of the pumping apparatus 210 may include a plurality of upper openings and a plurality of lower openings that provide fluid communication between the chambers 212, 213 and a center annulus of the pumping apparatus 210.

Additionally, the pumping apparatus 210 may include a valve system 220, similar to that shown in FIG. 1, including an upper valve 222, a lower valve 224 and a shaft 226. However, the upper and lower valves 222, 224 may include a plurality of upper and lower openings, respectively, that extend through the shaft 226. Similar to FIG. 1, the upper valve 222 and lower valve 224 may be configured to control the flow of the first fluid 218 entering and exiting the pumping apparatus 210. However, instead of directing the first fluid 216 into a fluid housing 230, as shown in FIG. 1, the valve system 220 may direct the first fluid 216 into the shaft 226. The shaft 226 is configured to transfer the first fluid 216 to the bit shaft 250. For example, as the bit shaft 226 rotates, an upper opening of the upper valve 222 aligns with an upper opening (not shown) in the chambers 212, 213 and allows the first fluid 216 to alternatingly enter the chambers 212, 213. Furthermore, as the bit shaft 226 rotates, a lower opening of the lower valve 224 aligns with a lower opening (not shown) in the chambers 212, 213 and allows the first fluid 216 to alternatingly exit the chambers 212, 213 and flow into the a channel 228 of the shaft 226. Finally, the channel 228 of the shaft 226 may transport the first fluid to the bit shaft 250 coupled to the end of the shaft 226. The first fluid 216 transported to the bit shaft 250 may further be transported through the bit shaft 250 to a drill bit attached to the lower distal end of the bit shaft 250.

The motor portion 240, as shown in FIG. 4, includes a motor valve 242 and at least one thrust bearing (not shown). The motor portion 240 may be configured similar to the motor portion 140 discussed above with reference to FIG. 1. However, as shown in FIG. 4, the second fluid 218 may be transferred directly from the chambers 212, 213 to the motor portion 240, instead of flowing through a channel of a fluid housing. In addition, the second fluid 218 may be transferred directly from the motor portion 240 back to the chambers 212, 213, instead of flowing through a channel of a fluid housing.

The bit shaft 250, as shown in FIG. 4, may be coupled to the motor portion 240 by means of a thrust bearing, similar to the bit shaft shown in FIG. 1. Further, like the bit shaft 150 shown in FIG. 1, the bit shaft 250 shown in FIG. 4 includes a channel 256 that is configured to receive and transfer the first fluid 216 to the drill bit attached to the lower distal end of the bit shaft 250. However, the channel 256 of bit shaft 250 in FIG. 4 may receive the fluid 216 directly from pumping apparatus 210, rather then from the annular space within the fluid housing, as shown in FIG. 1.

Referring still to FIG. 4, the downhole motor 200 is incorporated within a drilling assembly used to drill a formation, similar to the downhole motor 100 shown in FIG. 1. In operating this drilling assembly the downhole motor 200 is configured to receive a first fluid 216 from the drill string. The upper valve 222 is rotated to a position to allow the first fluid 216 into the first chamber 212 of the pumping apparatus 210. The valve system 220 is rotated at a predetermined speed. The predetermined speed may be dependent on the size of the wellbore, the type of formation, desired Rate of Penetration (ROP), and other factors known in the art.

As the first fluid 216 fills the first chamber 212, the first flexible diaphragm 214 compresses. The compression of the first flexible diaphragm 214 pressurizes the second fluid 218 disposed in the first flexible diaphragm 214, thereby transferring hydraulic energy from the first fluid 216 outside of the diaphragm 214 to the second fluid 218. The motor valve 242 may then be opened to allow the pressurized second fluid 218 to flow out of the first flexible diaphragm 214 and into the motor portion 240.

While the second fluid 218 flows through the motor portion 240, the motor portion 240 may convert the hydraulic energy of the second fluid 218 into mechanical energy, thereby creating torque. Further, the torque created by the motor portion 240 is transferred to the bit shaft 250 through at least one thrust bearing, which causes the bit shaft 250 to rotate.

After at least some of the second fluid 218 has passed through the motor portion 240, the motor valve 242 may direct the second fluid 218 to flow into the second flexible diaphragm 215 of the second chamber 213. As the second fluid 218 fills the second flexible diaphragm 215, the second flexible diaphragm 215 expands. The expansion of the second flexible diaphragm 215 pressurizes the first fluid 216 disposed in the second chamber 213, thereby transferring hydraulic energy from the second fluid 218 to the first fluid 216 outside the second flexible diaphragm 215. The lower valve 224 may then be rotated to a position to allow the pressurized first fluid 216 to flow out of the second chamber 213 and into the channel 228 of the shaft 226. The channel 228 of the shaft 226 then transfers the first fluid 216 to the channel 256 of the bit shaft 250. Finally, the channel 256 of the bit shaft 250 transfers the first fluid 216 to the drill bit attached to the lower distal end of the bit shaft 250. The drill bit may be configured similar to the drill bit discussed above with reference to FIG. 1.

Figure 5:
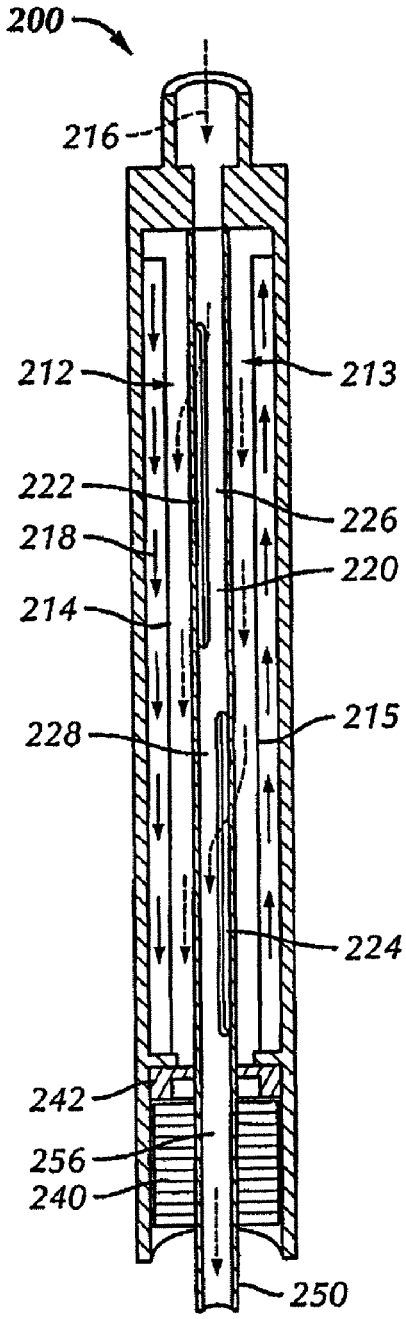
FIG. 5 shows a cross-sectional view of a downhole motor in accordance with embodiments of the present disclosure.

Referring now to FIG. 5, the upper valve 222 is rotated to a position to allow the first fluid 216 into the second chamber 213 of the pumping apparatus 210. As the first fluid 216 fills the second chamber 213, the second flexible diaphragm 215 will compress. The compression of the second flexible diaphragm 215 will pressurize the second fluid 218 disposed in the second flexible diaphragm 215, thereby transferring hydraulic energy from the first fluid 216 outside of the diaphragm 215 to the second fluid 218. The motor valve 242 may then allow the pressurized second fluid 218 to flow out of the second flexible diaphragm 215 and into the motor portion 240.

While the second fluid 218 flows through the motor portion 240, the motor portion 240 may convert the hydraulic energy of the second fluid 218 into mechanical energy, thereby creating torque. Further, the torque created by the motor portion 240 is transferred to the bit shaft 250 through at least one thrust bearing, which causes the bit shaft 250 to rotate.

After at least some of the second fluid 218 has passed through the motor portion 240, the motor valve 242 may direct the second fluid 218 to flow into the first flexible diaphragm 214 of the first chamber 212. As the second fluid 218 fills the first flexible diaphragm 214, the first flexible diaphragm 214 expands. The expansion of the first flexible diaphragm 214 pressurizes the first fluid 216 disposed in the first chamber 212, thereby transferring hydraulic energy from the second fluid 218 to the first fluid 216 outside the first flexible diaphragm 214. The lower valve 224 may then be rotated to a position to allow the pressurized first fluid 216 to flow out of the first chamber 212 and into the channel 228 of the shaft 226. The channel 228 of the shaft 226 then transfers the first fluid 216 to the channel 256 of the bit shaft 250. Finally, the channel 256 of the bit shaft 250 transfers the first fluid 216 to the drill bit attached to the lower distal end of the bit shaft 250.

One skilled in the art will understand that the flow of the first fluid 216 into the downhole motor 200 may be alternated between the first chamber 212 and the second chamber 213, thereby allowing the drill bit to be continuously turned. Further, one skilled in the art will understand that the operation of the downhole motor 200 may start with the flow of the first fluid 216 entering the first chamber 212 or the second chamber 213. Furthermore, in embodiments where the downhole motor includes three or more chambers, the flow of the first and second fluid may be alternated between one or more chambers.

Embodiments of the present disclosure may include one or more of the following advantages. Downhole motors found in accordance with one or more embodiments may use combinations of fluids i.e. (drilling mud and hydraulic fluid) to increase the life and reliability of the downhole motor. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole motor for drilling a wellbore, comprising:

a pumping apparatus comprising;

a valve system configured to control the flow of a first fluid and a second fluid, wherein the valve system fully rotates around a central axis of the pumping apparatus;

a first chamber configured to receive the first fluid and the second fluid, wherein the first fluid flows in an axial direction from the valve system into the first chamber;

a first flexible diaphragm disposed within the first chamber, wherein the first flexible diaphragm is disposed parallel to a direction of flow of the first fluid and wherein the first flexible diaphragm is configured to separate the first and second fluid, wherein the first flexible diaphragm is configured to transfer a hydraulic energy between the first fluid and the second fluid;

a second chamber configured to receive the first fluid and the second fluid, wherein the first fluid flows in an axial direction from the valve system into the second chamber, a second flexible diaphragm disposed within the second chamber, wherein the second flexible diaphragm is disposed parallel to a direction of flow of the first fluid and configured to separate the first and second fluids;

a motor portion coupled to the pumping apparatus and configured to receive the second fluid and convert the hydraulic energy of the second fluid into a mechanical energy, thereby creating a torque; and a bit shaft coupled to the motor portion, configured to receive the torque from the motor portion and the first fluid from the pumping apparatus.

2. The downhole motor assembly of claim 1, wherein the first fluid comprises a mud fluid.

3. The downhole motor assembly of claim 1, wherein the second fluid comprises a hydraulic fluid.

4. The downhole motor assembly of claim 1, wherein the first flexible diaphragm is configured to receive the first fluid.

5. The downhole motor assembly of claim 1, wherein the first flexible diaphragm is configured to receive the second fluid.

6. The downhole motor assembly of claim 1, wherein the second flexible diaphragm is configured to transfer a hydraulic energy between the first fluid and the second fluid.

7. The downhole motor assembly of claim 6, wherein the second flexible diaphragm is further configured to receive the first fluid.

8. The downhole motor assembly of claim 6, wherein the second flexible diaphragm is further configured to receive the second fluid.

9. The downhole motor assembly of claim 1, further comprising at least one thrust bearing disposed between the bit shaft and the motor portion.

10. The downhole motor assembly of claim 1, further comprising a fluid housing coupled to the pumping apparatus and the motor portion.

11. The downhole motor assembly of claim 10, wherein the fluid housing comprises an annular space.

12. The downhole motor assembly of claim 10, wherein the fluid housing comprises a first channel and a second channel.

13. The downhole motor assembly of claim 1, wherein the torque rotates the bit shaft and the valve system.

14. The downhole motor assembly of claim 13, wherein the valve system comprises an upper valve, a lower valve, and a shaft.

15. The downhole motor assembly of claim 14, wherein the valve system further comprises at least one sensor.

16. The downhole motor assembly of claim 1, wherein the motor portion further comprises a motor valve configured to control the flow of the second fluid entering and exiting the motor portion.

17. The downhole motor assembly of claim 1, wherein the motor portion further comprises at least two check valves configured to control the flow of the second fluid entering and exiting the motor portion.

18. A method of operating a downhole motor comprising:

pumping a first fluid containing hydraulic energy to the downhole motor;

fully rotating a valve system around a central axis of the downhole motor at a predetermined speed;

directing the flow of the first fluid into a first chamber of a pumping apparatus, wherein the first fluid flows in an axial direction from the valve system into the first chamber;

transferring hydraulic energy from the first fluid to a second fluid through a first flexible diaphragm disposed parallel to a direction of flow of the first fluid in the first chamber;

directing the flow of the second fluid from the pumping apparatus into a motor portion;

allowing the second fluid to flow through the motor portion and into a second chamber, wherein the motor portion is configured to transfer hydraulic energy of the second fluid into a mechanical energy, thereby creating torque;

rotating a bit shaft with the torque generated from the motor portion; and directing the flow of the first fluid from the pumping apparatus to the bit shaft.

19. The method of claim 18, further comprising controlling the flow of the first fluid and the second fluid entering and exiting the pumping apparatus with the valve system.

20. The method of claim 18, further comprising controlling the flow of the second fluid entering and exiting the pumping apparatus with at least one of a group consisting of a check valve and a motor valve.

21. The method of claim 18, further comprising transferring a torque generated by the motor portion to the bit shaft.

22. The method of claim 18, wherein the first fluid comprises a mud fluid.

23. The method of claim 18, wherein the second fluid comprises a hydraulic fluid.

* * * * *